US010060303B2

(12) United States Patent
Berndt

(10) Patent No.: US 10,060,303 B2
(45) Date of Patent: Aug. 28, 2018

(54) CAMSHAFT PHASER USING ONE-WAY SLIPPER CLUTCHES

(71) Applicant: Schaeffler Technologies AG & Co. KG, Herzogenaurach (DE)

(72) Inventor: Eric Berndt, Whitefish Bay, WI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 128 days.

(21) Appl. No.: 15/333,676

(22) Filed: Oct. 25, 2016

(65) Prior Publication Data

US 2017/0037749 A1 Feb. 9, 2017

(51) Int. Cl.

| | |
|---|---|
| ***F01L 1/344*** | (2006.01) |
| ***F01L 1/047*** | (2006.01) |
| *F01L 1/46* | (2006.01) |
| *F01L 13/00* | (2006.01) |

(52) U.S. Cl.

CPC ..... *F01L 1/34409* (2013.01); *F01L 1/047* (2013.01); *F01L 1/344* (2013.01); *F01L 1/46* (2013.01); *F01L 2001/0475* (2013.01); *F01L 2001/34459* (2013.01); *F01L 2001/34463* (2013.01); *F01L 2001/34473* (2013.01); *F01L 2013/101* (2013.01); *F01L 2250/02* (2013.01); *F01L 2250/04* (2013.01); *F01L 2250/06* (2013.01); *F01L 2800/12* (2013.01); *F01L 2820/031* (2013.01); *F01L 2820/032* (2013.01); *F01L 2820/033* (2013.01); *F01L 2820/034* (2013.01)

(58) Field of Classification Search

CPC ..... F01L 2001/0475; F01L 1/344; F01L 1/34409; F01L 1/46; F01L 2013/101

USPC ..... 123/90.15, 90.17

See application file for complete search history.

(56) References Cited

U.S. PATENT DOCUMENTS

| | | | | |
|---|---|---|---|---|
| 7,669,566 | B2 | 3/2010 | Methley | |
| 2011/0162605 | A1 | 7/2011 | Wigsten | |
| 2016/0319710 | A1* | 11/2016 | Shewell | F01L 1/344 |
| 2016/0319712 | A1* | 11/2016 | Manther | F01L 1/34409 |

* cited by examiner

*Primary Examiner* — Jorge Leon, Jr.

(74) *Attorney, Agent, or Firm* — Brooks Kushman P.C.

(57) ABSTRACT

A camshaft phaser comprising an advance one-way clutch and a retard one-way clutch. The camshaft phaser comprises an input component arranged to receive torque from an engine, an advance inner ring, a plurality of rollers circumferentially arranged around the advance inner ring, an advance outer ring radially disposed between the input component and the advance inner ring, and an actuation assembly arranged to be disposed within a camshaft, the actuation assembly comprises advance locking pin assemblies arranged in advance channels and an actuator rod. For an advanced mode, the actuator rod is arranged to radially displace advance locking pin assemblies to non-rotatably connect the camshaft and advance inner ring, the rollers ride up ramps on advance outer ring, which expands radially to engage the input component. The retard clutch is substantially similar, and arranged diametrically opposed, to the advance clutch.

20 Claims, 10 Drawing Sheets

CAMSHAFT PHASER USING ONE-WAY SLIPPER CLUTCHES

FIELD

The present disclosure relates to a camshaft phaser for variable cam timing in an internal combustion engine, in particular, a camshaft phaser that utilizes one-way slipper clutches. An axially displaceable component is used to engage and disengage the one-way clutches to enable the camshaft phaser to shift between advance and retard modes.

BACKGROUND

It is known to use hydraulic fluid in an internal combustion engine to phase a camshaft for the engine. However, hydraulic camshaft phasers are not typically used in small engines due to the required oil supply. Small engines used in recreational vehicle applications (e.g., for motorcycles, all-terrain vehicles (ATVs), boats, etc.) have a limited supply of hydraulic fluid, which limits the use of the hydraulic fluid for phasing and may compromise the operation of the engine and the camshaft phasing.

It therefore is an object of the disclosure to provide a camshaft phaser that does not require hydraulic fluid for small engine vehicles that could benefit from variable camshaft timing technology.

SUMMARY

According to aspects illustrated herein, there is provided a camshaft phaser, comprising an input component arranged to receive torque from an engine, an advance inner ring, a plurality of rollers circumferentially arranged around the advance inner ring, an advance outer ring radially disposed between the input component and the advance inner ring, and an actuation assembly arranged to be disposed in a channel for a camshaft, the actuator assembly comprises one or more advance locking pin assemblies operatively arranged in one or more advance channels and an actuator rod. For an advanced mode, the actuator rod is arranged to radially displace the one or more advance locking pin assemblies to engage the advance inner ring such that the camshaft and the advance inner ring are non-rotatably connected, the advance inner ring is arranged to rotate, with respect to the input component, in a first circumferential direction, and the advance outer ring is arranged to block rotation of the advance inner ring with respect to the input component, in a second circumferential direction, opposite the first circumferential direction.

According to aspects illustrated herein, there is provided a camshaft assembly, comprising a camshaft including one or more advance channels and one or more retard channels, and a camshaft phaser including an advance inner ring, a retard inner ring, and an actuation assembly. The actuation assembly comprises one or more advance locking pin assemblies disposed in the one or more advance channels and one or more retard locking pin assemblies disposed in the one or more retard channels, and an actuator rod. For an advance mode the actuator rod is arranged to radially displace the one or more advance locking pin assemblies into non-rotatable contact with the advance inner ring, the camshaft is arranged to rotate, with respect to the input component, in a first circumferential direction, and the advance inner ring is arranged to block rotation of the camshaft, with respect to the input component, in a second circumferential direction, opposite the first circumferential direction. For a retard mode, the actuator rod is arranged to radially displace the retard locking pin assembly into non-rotatable contact with the retard inner ring, the camshaft is arranged to rotate, with respect to the input component, in the second circumferential direction, and the retard inner ring is arranged to block rotation of the camshaft, with respect to the input component in the first circumferential direction.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, and/or pneumatics.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required.

Figure 1:
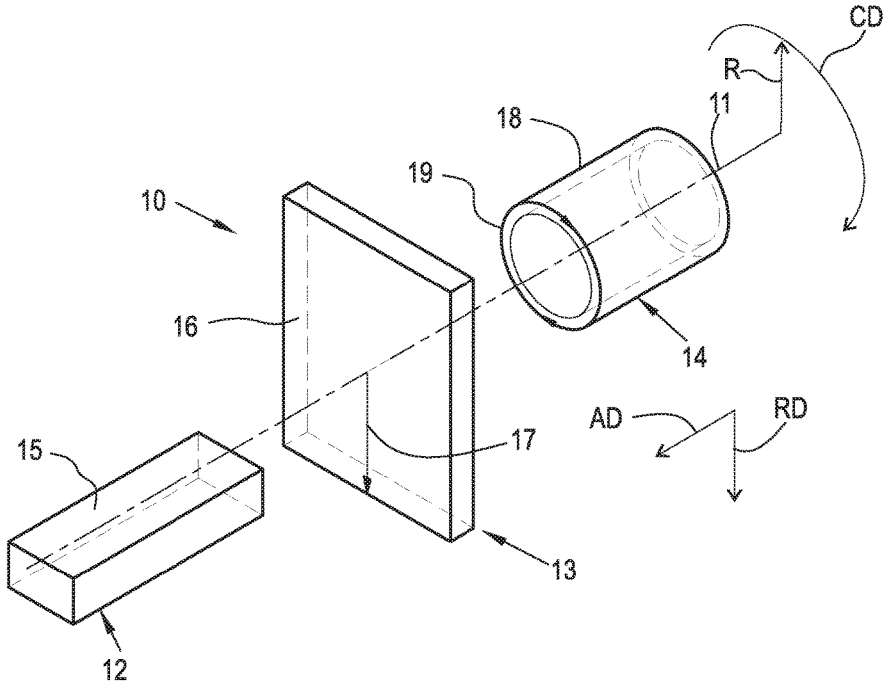
FIG. 1 is a perspective view of a cylindrical coordinate system demonstrating spatial terminology used in the present application.

Adverting now to the figures, FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 22, is formed by a plane co-planar with axis 11. Axis 11 passes through planar surface 15; however any planar surface co-planar with axis 11 is an axial surface. A radial surface, such as surface 16 of object 13, is formed by a plane orthogonal to axis 11 and co-planar with a radius, for example, radius 17. Radius 17 passes through planar surface 16; however any planar surface co-planar with radius 17 is a radial surface. Surface 18 of object 14 forms a circumferential, or cylindrical, surface. For example, circumference 19 passes through surface 18. As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively. For example, an axially disposed surface or edge extends in direction AD, a radially disposed surface or edge extends in direction R, and a circumferentially disposed surface or edge extends in direction CD.

Figure 2:
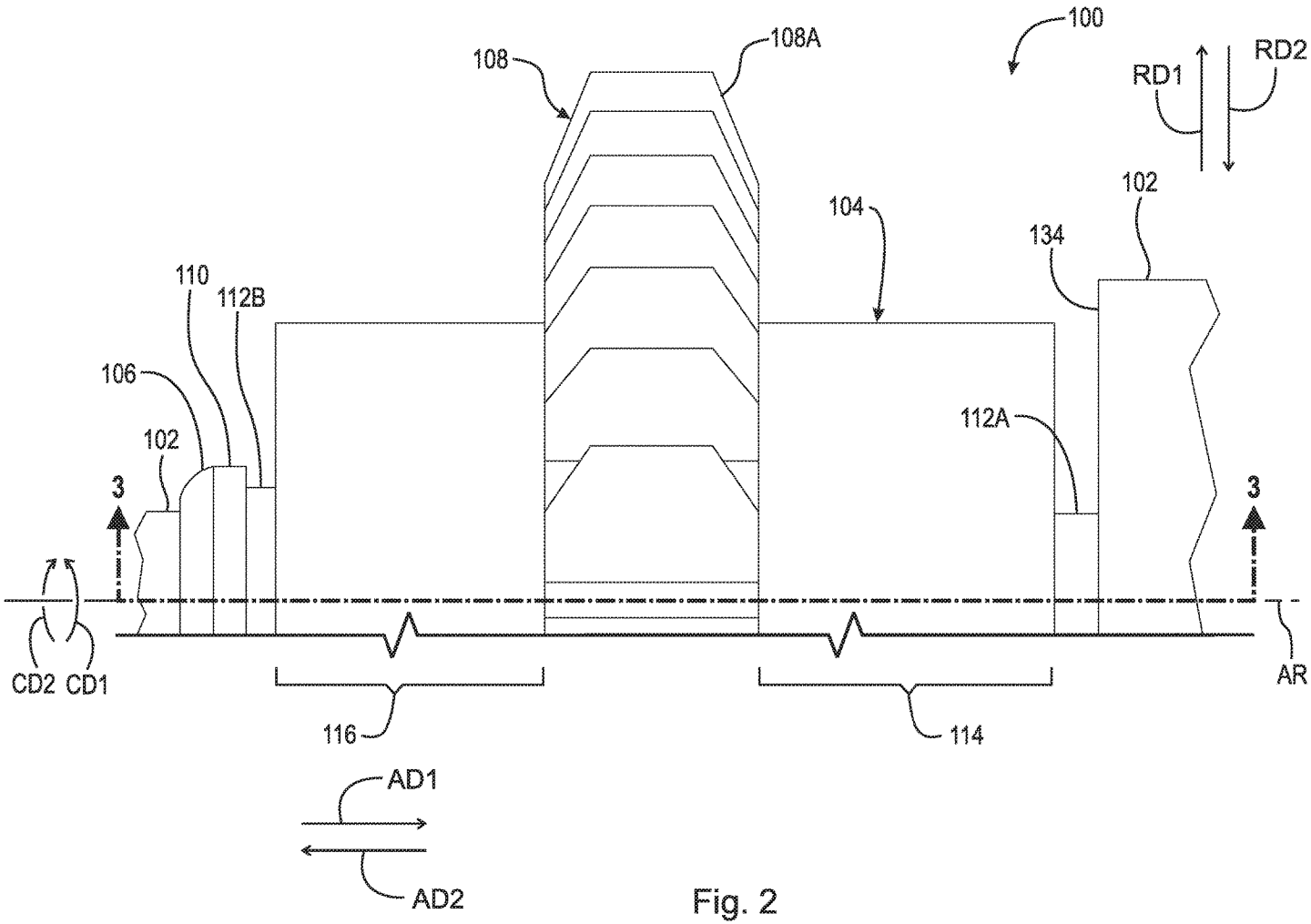
FIG. 2 is a top perspective view of a camshaft assembly with a camshaft phaser, having two one-way slipper clutches.

FIG. 2 is a top perspective view of camshaft assembly 100 with a camshaft phaser having two one-way slipper clutches. Camshaft assembly 100 generally includes camshaft 102, camshaft phaser 104, and input component 108, arranged concentrically about axis of rotation AR. Input component 108 is arranged radially outside of, and is non-rotatably connected to, camshaft phaser 104, which is arranged radially around camshaft 102. In an example embodiment, input component 108 is a drive sprocket 108A connected to a drive chain, belt, or gear. It should be appreciated, however, that input component 108 can be any component capable of being connected to a driveshaft such that rotational force is transmitted from the driveshaft to input component 108. For example, input component 108 can be a sprocket, gear, or pulley connected to the driveshaft via a belt, band, track, cable, chain or other perforated or indented material, or direct engagement. Thrust bearings 112A and 112B are axially arranged on either end of camshaft phaser 104. Thrust bearings 112A and 112B allow circumferential movement of camshaft phaser 104 while it is axially locked. In an example embodiment, camshaft phaser 104 is axially secured on camshaft 102 by thrust bearing 112A and camshaft flange 134, on a first end, and thrust bearing 112B, thrust washer 110, and nut 106, on a second end. It should be appreciated, however, that any other suitable means of axially securing camshaft phaser 104 on camshaft 102, such that camshaft phaser 104 is capable of circumferential movement, can be used. In an example embodiment, thrust bearings 112A and 112B, thrust washer 110, and nut 106 are annular-shaped and are arranged concentrically about axis of rotation AR.

Figure 3:
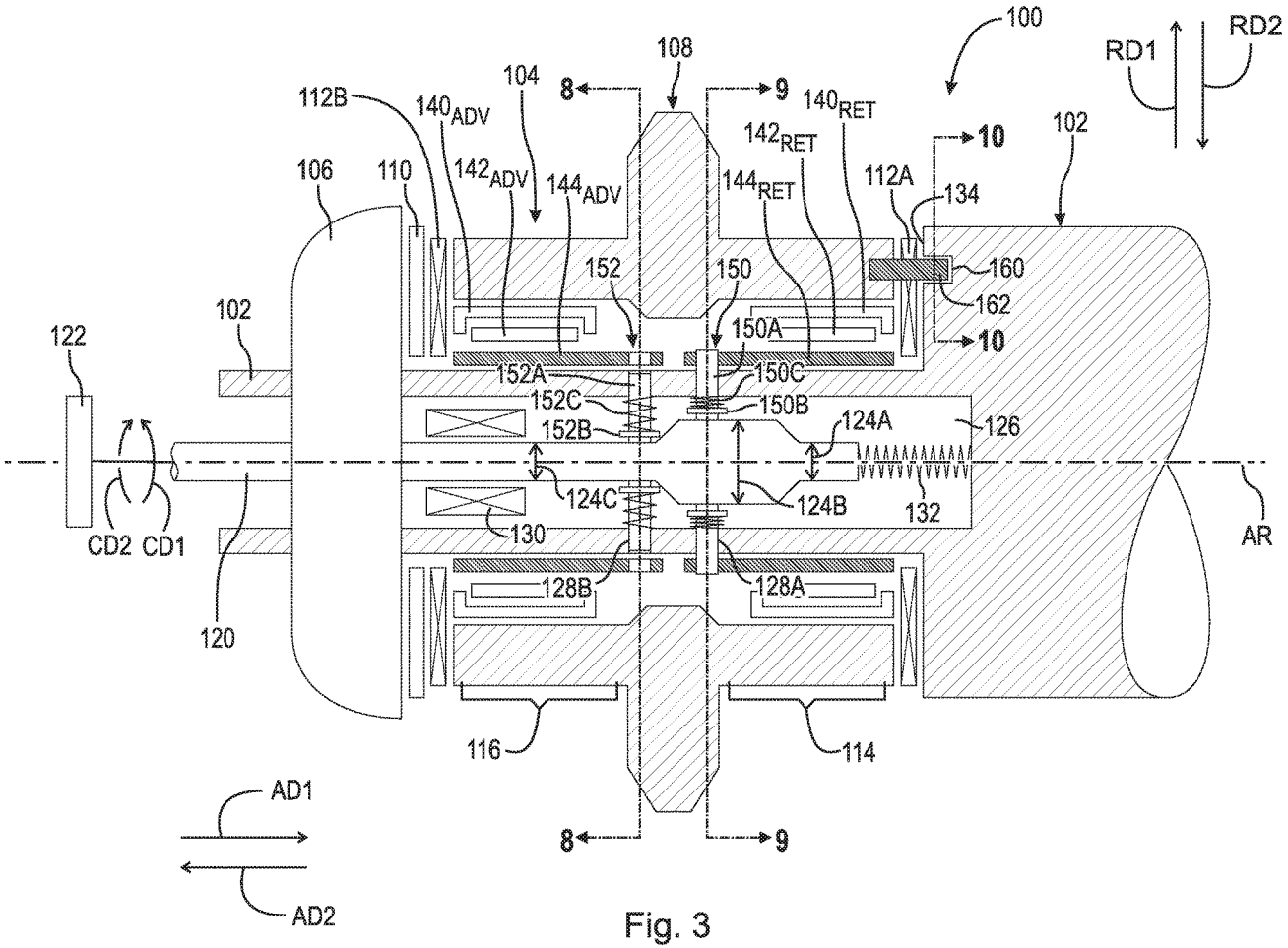
FIG. 3 is cross-sectional view taken generally along line 3-3 in FIG. 2 with the camshaft phaser in a retard mode.

FIG. 3 is a cross-sectional view taken generally along line 3-3 in FIG. 2 with camshaft phaser 104 in a retard mode. In retard mode, retard locking pin assembly 150 is engaged with retard inner ring $\mathbf{144}_{RET}$ and advance locking pin assembly 152 is not engaged with advance inner ring $\mathbf{144}_{ADV}$. Camshaft phaser 104 comprises retard clutch 114 and advance clutch 116. Retard clutch 114 and advance clutch 116 are substantially similar one-way slipper clutches operatively arranged to transmit torque in opposite circumferential directions. Advance clutch 116 comprises, from radially out to radially in, outer ring $\mathbf{140}_{ADV}$, rollers $\mathbf{142}_{ADV}$, and inner ring $\mathbf{144}_{ADV}$ concentrically arranged with camshaft 102 around axis of rotation AR. Likewise, retard clutch 114 comprises, from radially out to radially in, outer ring $\mathbf{140}_{RET}$, rollers $\mathbf{142}_{RET}$, and inner ring $\mathbf{144}_{RET}$ concentrically arranged with camshaft 102 around axis of rotation AR. Although not shown, optional radial bearings could be used between camshaft 102 and input component 108 to accommodate radial loads during phasing.

The following description can be viewed as referring to either retard clutch 114 or advance clutch 116, it being understood that retard clutch 114 and advance clutch 116 are substantially similar. Outer ring 140 is a circular tube comprising at least one circumferential gap, such that it is discontinuous in a circumferential direction and is capable of expanding radially outward. Outer ring 140 radially inwardly facing surface $\mathbf{140}_{IC}$ comprises a plurality of ramps 140A arranged circumferentially thereon. Rollers 142 comprise a plurality of rolling elements radially arranged between outer ring 140 and inner ring 144, and circumferentially arranged to interfere with ramps 140A. In an example embodiment, retard clutch 114 and advance clutch 116 further comprise a cage and/or bias springs to control the movement of rollers 142. For example, bias springs can be operatively arranged to encourage movement of rollers 142 into ramps 140A, to provide a faster engagement, or away from ramps 140A, to provide a quieter engagement (e.g. to minimize objectionable noise).

Inner ring 144 is a circular tube comprising a plurality of through-bores 144A-F. Inner ring 144 and camshaft 102 have a clearance fit with a resulting radial clearance gap. In an example embodiment, inner ring 144 and camshaft 102 have a sliding fit. In an example embodiment, inner ring 144 and camshaft 102 have a running fit. Through-bores 144A-F are circumferentially arranged on inner ring 144 such that, when camshaft phaser 104 is assembled, no contact occurs between rollers 142 and through-bores 144A-F (see FIGS. 8 and 9). In an example embodiment, ramps 140A are located on inner ring 144 radially outwardly facing surface $\mathbf{144}_{OC}$ instead of outer ring 140 radially inwardly facing surface $\mathbf{140}_{IC}$.

Figure 5:
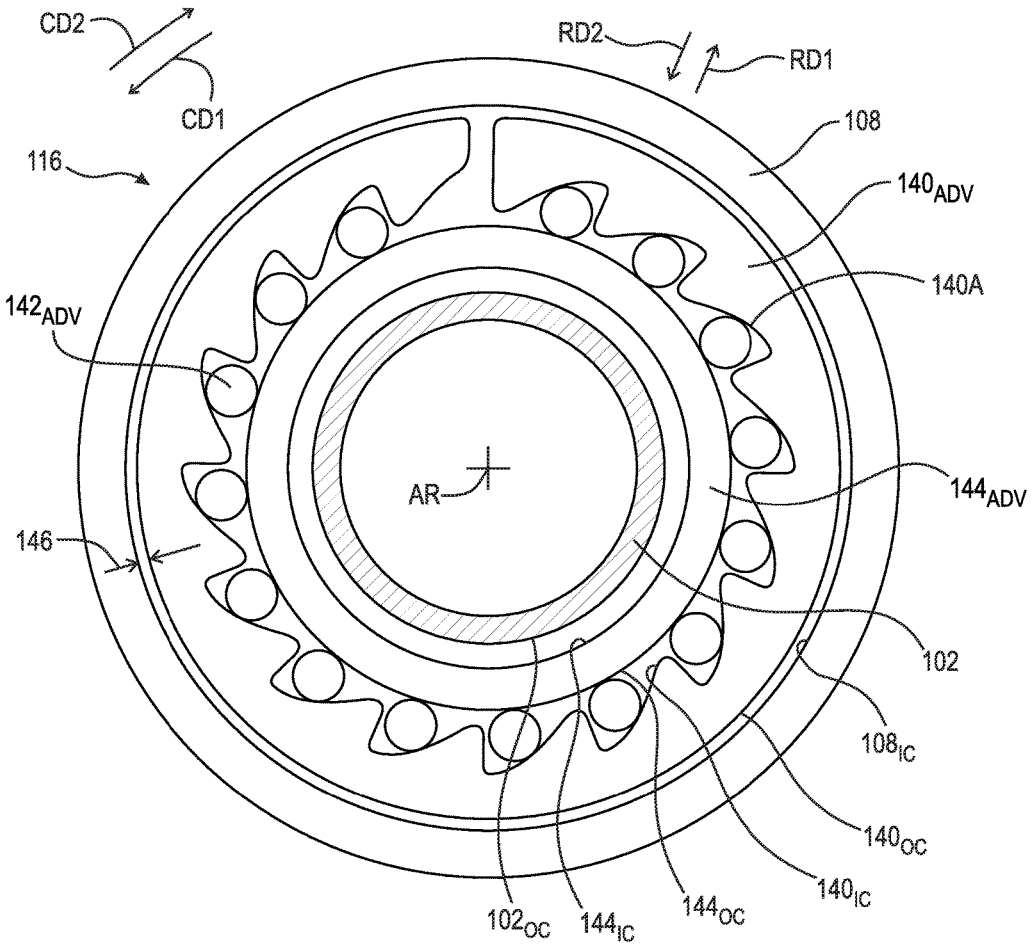
FIG. 5 is a front planar view of the disengaged advance clutch assembled on the camshaft shown in FIG. 3.
Figure 6:
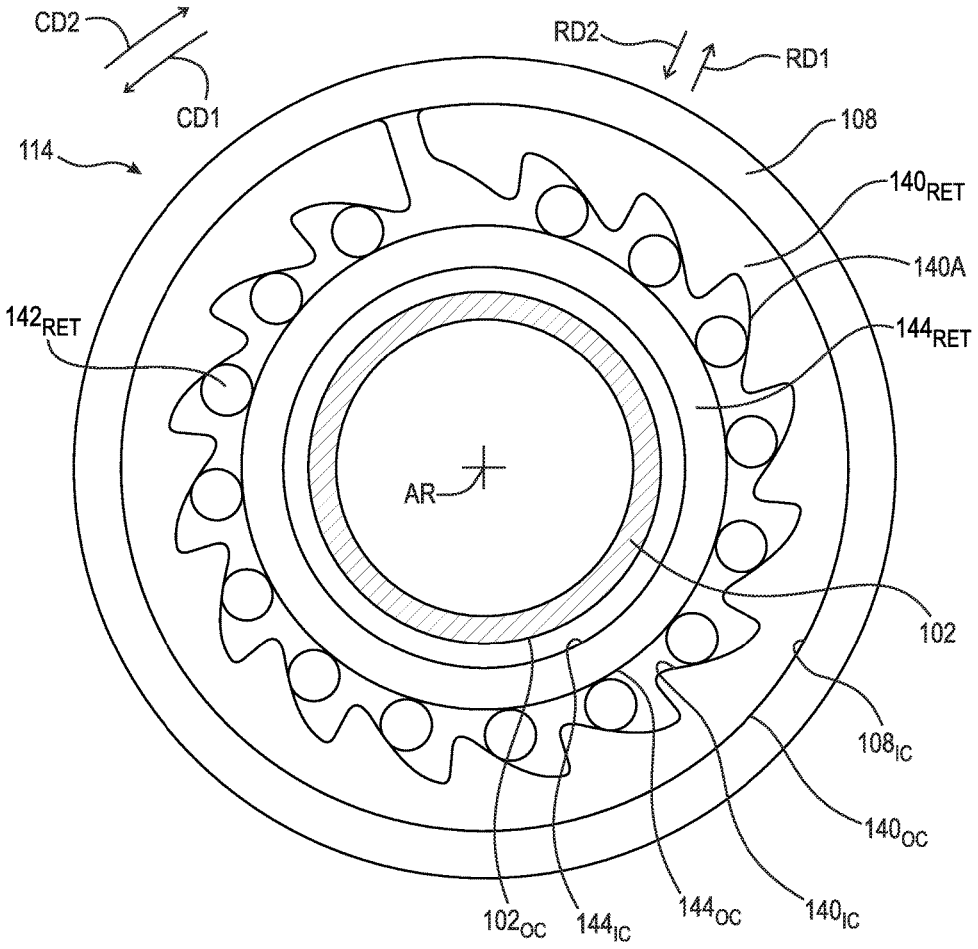
FIG. 6 is a front planar view of the engaged retard clutch assembled on the camshaft shown in FIG. 3.

When relative motion occurs between outer ring 140 and inner ring 144 in a first circumferential direction, rollers 142 ride up ramps 140A and become pinched between outer ring 140 radially inwardly facing surface $\mathbf{140}_{IC}$ and inner ring 144 radially outwardly facing surface $\mathbf{144}_{OC}$ (see FIGS. 5-6). This causes outer ring 140 to radially expand such that outer ring 140 radially outwardly facing surface $\mathbf{140}_{OC}$ frictionally engages input component 108 radially inwardly facing surface $\mathbf{108}_{IC}$ and torque is transmitted from input component 108 to inner ring 144 (see FIG. 6). When relative motion occurs between outer ring 140 and inner ring 144 in a second circumferential direction, opposite the first circumferential direction, rollers 142 fall down ramps 140A and no torque is transmitted between input component 108 and inner ring 144 (see FIG. 5). The disengaged clutch is considered to be in freewheeling, or overrunning, mode. Retard clutch 114 and advance clutch 116 are arranged in reversed positions such that, a first relative motion in the first circumferential direction engages retard clutch 114 but disengages advance clutch 116, and a second relative motion in the second circumferential direction disengages retard clutch 114 but engages advance clutch 116. For the purposes of this disclosure, the first relative motion refers to movement of outer ring 140 in circumferential direction CD1 relative to inner ring 144 or movement of inner ring 144 in circumferential direction CD2, and thereby engages retard clutch 114 and disengages advance clutch 116. The second relative motion refers to movement of outer ring 140 in circumferential direction CD2 relative to inner ring 144 or movement of inner ring 144 in circumferential direction CD1, and thereby disengages retard clutch 114 and engages advance clutch 116. It should be appreciated, however, that identical engagement/disengagement results can be achieved by simply arranging retard clutch 114 and advance clutch 116 in reversed positions.

Camshaft 102 is a cylindrical rod comprising a lobe end, which extends the length of the cylinder line (or cylinder bank in Vee engines or Boxer engines), and input component end, to which camshaft phaser 104 is secured, separated by camshaft flange 134. Camshaft 102 comprises circular actuator channel 126 arranged concentrically therein. Circular actuator channel 126 extends in axial direction AD1 at least partially through camshaft 102. Camshaft 102 input component end comprises retard channels 128A and advance channels 128B. Retard channels 128A and advance channels 128B each comprise two through-bores radially arranged 180 degrees apart. In an example embodiment, retard channels 128A and advance channels 128B each comprise one or more through-bores radially arranged at equal angles of separation. Retard locking pin assemblies 150 and advance locking pin assemblies 152 are arranged within retard channels 128A and advance channels 128B, respectively. Retard locking pin assemblies 150 comprise pin 150A, retainer ring 150B, and spring 150C. Advance locking pin assemblies 152 comprise pin 152A, retainer ring 152B, and spring 152C. Springs 150C and 152C are operatively arranged between camshaft channel 126 radial surface and respective retainer rings 150B and 152B such that respective pins 150A and 152A are biased in a radially inward direction. In an example embodiment, camshaft 102 comprises slot 160 in camshaft flange 134.

Actuator rod 120 is a cylinder comprising a defined profile. Actuator rod 120 is connected to actuator 122 and is operatively arranged to move axially within actuator channel 126 to force retard locking pin assemblies 150 and advance locking pin assemblies 152 radially outward. Actuator rod 120 is radially positioned within actuator chamber 126 by bearing 130. Bias spring 132 is used to assist actuator 122 in axially moving actuator rod 120. In an example embodiment, bias spring 132 is in compression and encourages actuator rod 120 in axial direction AD2. In addition, bias spring 132 helps position actuator rod 120 during a failsafe mode, in case of failure of actuator 122 or engine shut down. Failsafe mode is defined for each application. In an example embodiment, failsafe mode places camshaft 102 in either the fully advanced or fully retarded position. In an example embodiment, failsafe mode places camshaft 102 in a mid-lock position (i.e., both retard clutch 114 and advance clutch 116 are engaged). In an example embodiment, actuator rod 120 comprises diameters 124A, 124B, and 124C. Diameter 124B is large enough such that, when aligned, locking pin assemblies 150 and 152 are displaced radially outward and engage inner plate 144. Diameters 124A and 124C are less than diameter 124B and are small enough such that, when aligned, locking pin assemblies 150 and 152 are displaced radially outward but do not engage inner ring 144.

Actuator 122 is any mechanism capable of axially moving actuator rod 120 and maintaining its axial position within actuator channel 126. In an example embodiment, actuator 122 is a two-position actuator. In an example embodiment, actuator 122 is a three-position actuator. Various electric (and electromagnetic), mechanical, hydraulic, and pneumatic actuators could be envisioned for controlling the axial movement and position of actuator rod 120. Actuator 122 may rotate with camshaft 102 or be mounted in a stationary position. In an example embodiment, actuator 122 is replaced with a centrifugal linear governor (e.g., mechanical governors designed for steam engines), which engages/disengages the clutches without external controls or actuators. In this example embodiment, the centrifugal linear governor causes the camshaft phaser to advance or retard based solely on the engine speed and is especially beneficial for low cost applications (e.g., scooters).

To transmit torque from inner ring 144 to camshaft 102, the desired locking pin assemblies are employed and their respective pins forced radially outward. When the pins encounter a radial gap in the extended portion of inner ring 144 they engage and non-rotatably connect inner ring 144 to camshaft 102. In FIG. 3, retard clutch 114 is engaged and advance clutch 116 is disengaged. However, either retard clutch 114 or advance clutch 116, or both retard clutch 114 and advance clutch 116, can be engaged at a given time. If one clutch is engaged and one clutch is disengaged, torque will only be transmitted from input component 108 to camshaft 102 in one circumferential direction. Due to the natural torque variations in the camshaft of an internal combustion engine (i.e., counterforce from valve springs exerted on lobes), input component 108 will either advance or retard in timing (i.e., rotate circumferentially) relative to camshaft 102. To reverse this motion, actuator 122 repositions actuator rod 120 to switch the engaged/disengaged clutches. The motion will continue until an end stop is reached, resulting in a fully advanced or fully retarded phaser position (see FIG. 10). Thus, if only two phasing positions are desired (e.g., fully advanced and fully retarded), actuator 122 is a two-position actuator. To stop the motion at a position in between the two end stops (i.e., mid-lock position), actuator 122 repositions actuator rod 120 to engage both clutches, resulting in a partially advanced or partially retarded phaser position (see FIG. 7). Thus, if more than two phasing positions are desired (e.g., fully advanced, fully retarded, and partially advanced/retarded), actuator 122 is a three-position actuator.

Figure 4:
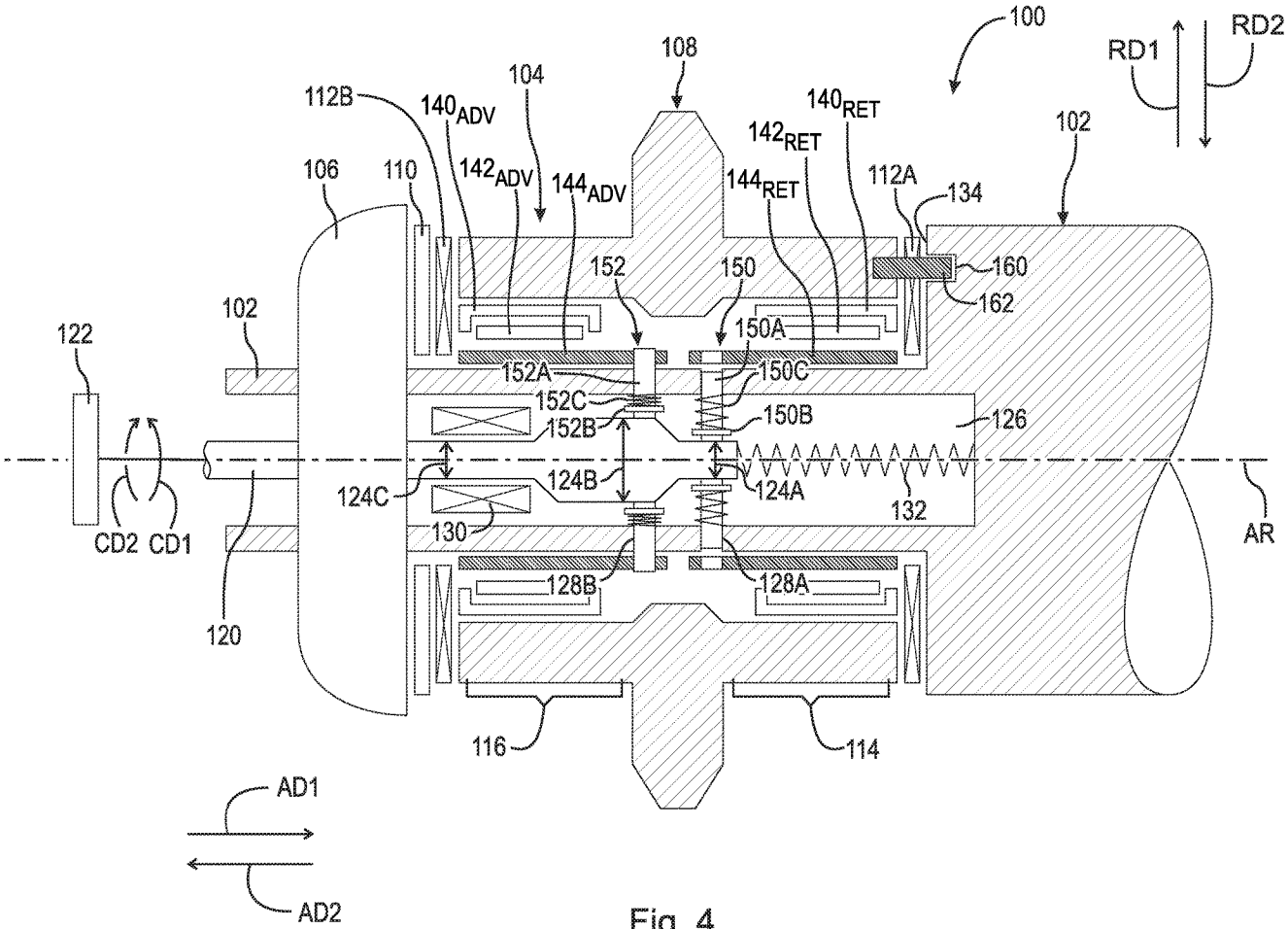
FIG. 4 is a cross-sectional view of the camshaft assembly in FIG. 3 in an advanced mode.

FIG. 4 is a cross-sectional view of camshaft assembly 100 shown in FIG. 3 in an advanced mode. In advanced mode, retard locking pin assembly 150 is not engaged with retard inner ring $\mathbf{144}_{RET}$ and advance locking pin assembly 152 is engaged with advance inner ring $\mathbf{144}_{ADV}$. To move from retard mode to advanced mode, actuator 122 moves actuator rod 120 to align diameter 124B with advance locking pin assemblies 152. Advance pins 152A are displaced radially outward to engage advance inner ring $\mathbf{144}_{ADV}$ at respective gaps 144A-F. Input component 108 will advance in timing relative to camshaft 102.

FIG. 5 is a front planar view of the disengaged advance clutch 116 assembled on camshaft 102 shown in FIG. 3. For the purposes of this disclosure, the front planar view in FIGS. 5 and 6 refers to the view from actuator 122 looking in direction AD1. When the first relative motion, movement of the advance outer ring $\mathbf{140}_{ADV}$ in circumferential direction CD1 relative to the advance inner ring $\mathbf{144}_{ADV}$, or movement of the advance inner ring $\mathbf{144}_{ADV}$ in circumferential direction CD2, occurs, advance rollers $\mathbf{142}_{ADV}$ of advance clutch 116 fall down ramps 140A disengaging advance clutch 116 and no torque is transmitted between input component 108 and advance inner ring $\mathbf{144}_{ADV}$. The disengaged clutch is considered to be in freewheeling, or overrunning, mode. When advance clutch 116 (or retard clutch 114) is disengaged, gap 146 exists between advance outer ring $\mathbf{144}_{ADV}$ radially outwardly facing surface $\mathbf{144}_{OC}$ and input component 108 radially inwardly facing surface $\mathbf{108}_{IC}$. Retard clutch 114 and advance clutch 116 are arranged in reversed positions such that, a first relative motion engages retard clutch 114 but disengages advance clutch 116, and a second relative motion in the second circumferential direction disengages retard clutch 114 but engages advance clutch 116.

FIG. 6 is a front planar view of the engaged retard clutch 114 assembled on camshaft 102 shown in FIG. 3. Note that ramps 140A are opposite in direction than ramps 140A in FIG. 5. This is because advance clutch 116 and retard clutch 114 are arranged diametrically opposed on camshaft 102. When relative motion occurs between retard outer ring $\mathbf{140}_{RET}$ and retard inner ring $\mathbf{144}_{RET}$ in a first circumferential direction, retard rollers $\mathbf{142}_{RET}$ of retard clutch 114 ride up ramps 140A and become pinched between retard outer ring $\mathbf{140}_{RET}$ radially inwardly facing surface $\mathbf{140}_{IC}$ and retard inner ring $\mathbf{144}_{RET}$ radially outwardly facing surface $\mathbf{144}_{OC}$. This causes retard outer ring $\mathbf{140}_{RET}$ to radially expand such that retard outer ring $\mathbf{140}_{RET}$ radially outwardly facing surface $\mathbf{140}_{OC}$ frictionally engages input component 108 radially inwardly facing $\mathbf{108}_{IC}$ surface and torque is transmitted from input component 108 to retard inner ring $\mathbf{144}_{RET}$.

Figure 7:
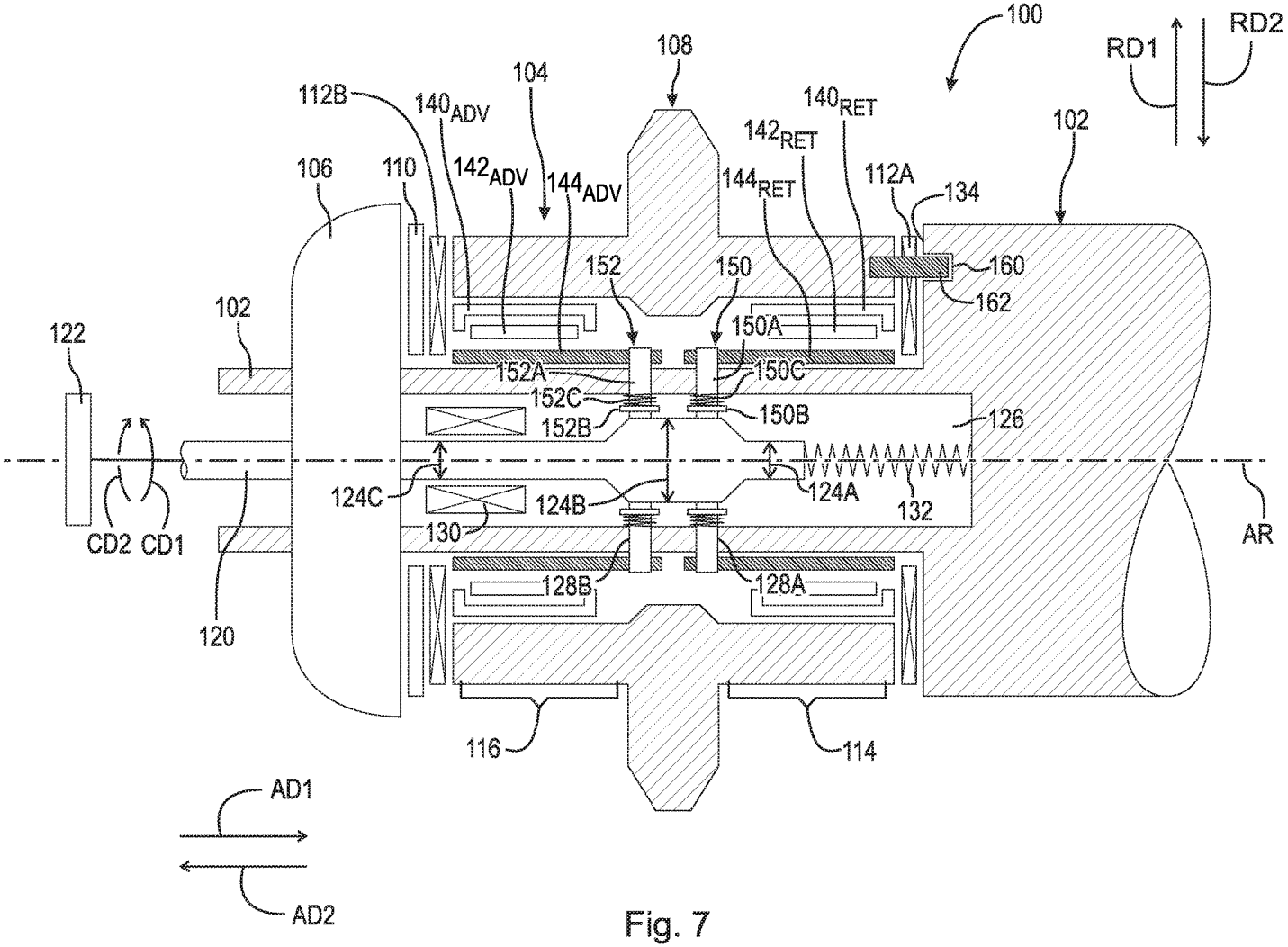
FIG. 7 is a cross-sectional view similar to the view of the camshaft assembly in FIG. 3, except in a drive mode.

FIG. 7 is a cross-sectional view of camshaft assembly 100 similar to the view shown in FIG. 3, except in a drive mode. In drive mode, both retard locking pin assemblies 150 and advance locking pin assemblies 152 are engaged with retard and advance inner rings $\mathbf{144}_{RET}$ and $\mathbf{144}_{ADV}$, respectively. To move to drive mode, actuator 122 moves actuator rod 120 to align diameter 124B with both retard locking pin assemblies 150 and advance locking pin assemblies 152. Retard pins 150A and advance pins 152A are displaced radially outward to engage respective inner rings 144 at respective gaps 144A-F. Input component 108 will not retard or advance in timing relative to camshaft 102, and thus will be in a mid-lock position.

Figure 8:
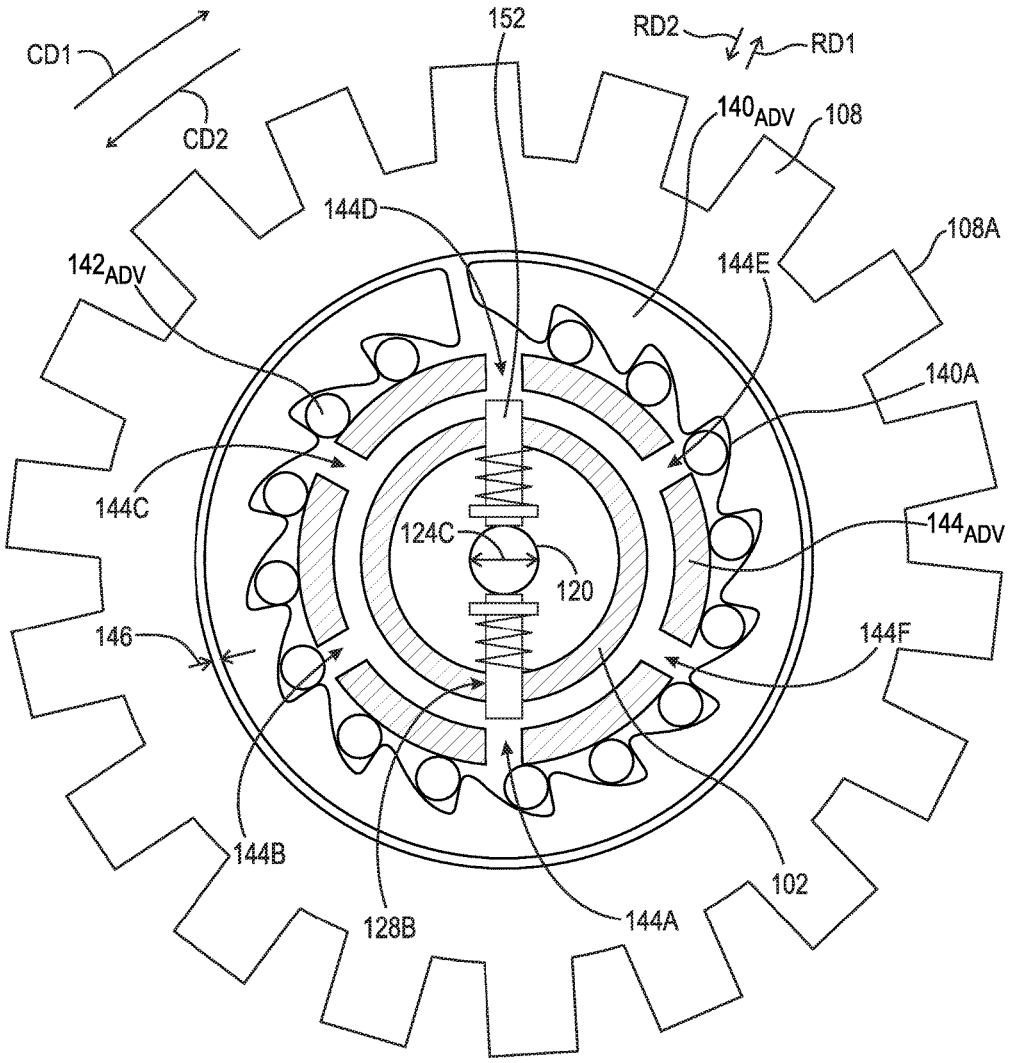
FIG. 8 is a cross-sectional view taken generally along line 8-8 in FIG. 3 with the camshaft phaser in a retard mode.

FIG. 8 is a cross-sectional view taken generally along line 8-8 in FIG. 3 with camshaft phaser 104 in a retard mode. FIG. 8 shows advance locking pin assemblies 152 with advance clutch 116 in a disengaged mode. Actuator 122 moves actuator rod 120 to align diameter 124C with advance locking pin assemblies 152. Advance pins 152A do not engage advance inner ring $\mathbf{144}_{ADV}$ at gaps 144A-F and thus no torque is transferred between camshaft 102 and advance inner ring $\mathbf{144}_{ADV}$. Advance rollers $\mathbf{142}_{ADV}$ do not ride up ramps 140A when input component 108 rotates in direction CD1 relative to camshaft 102. Radial gap 146 exists between input component 108 and advance outer ring $\mathbf{140}_{ADV}$ and thus no torque is transferred from input component 108 to advance outer ring $\mathbf{140}_{ADV}$. As such, torque is not transferred between input component 108 and camshaft 102.

Figure 9:
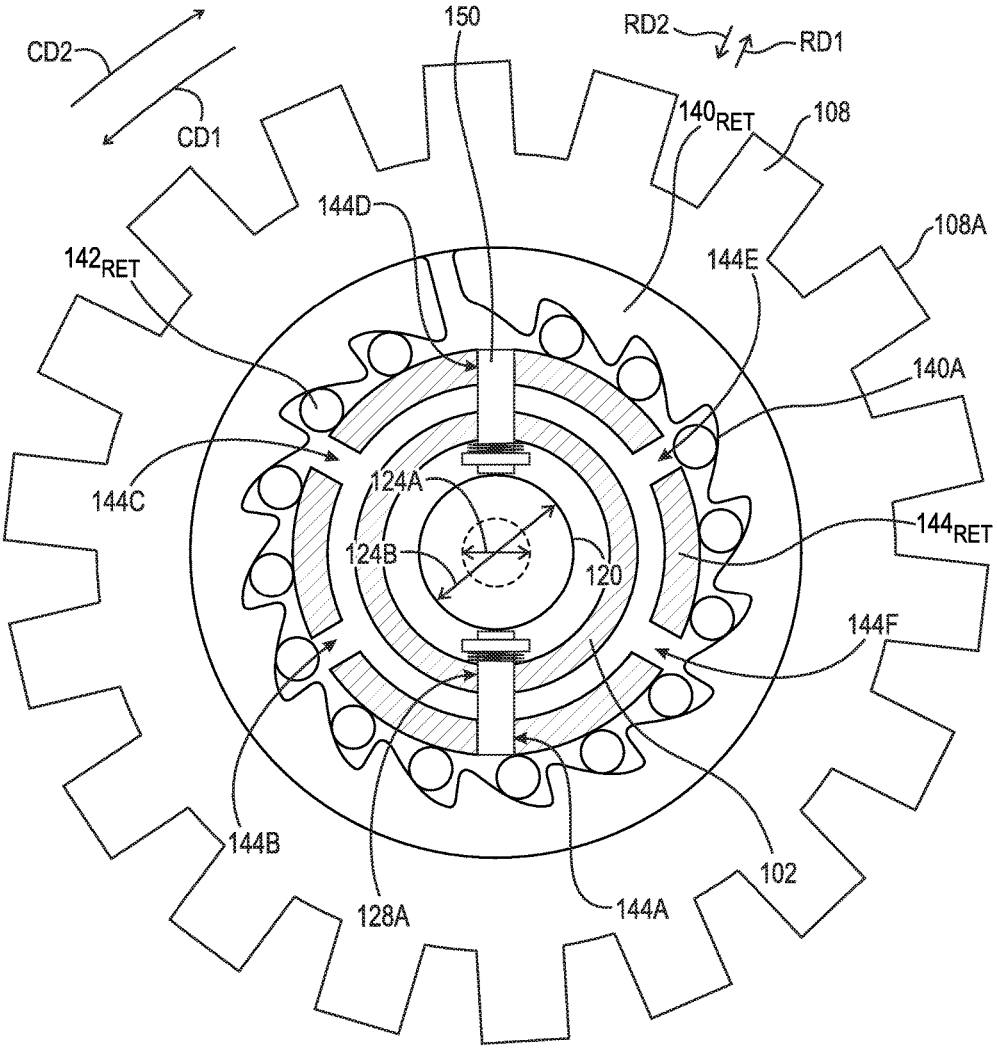
FIG. 9 is a cross-sectional view taken generally along line 9-9 in FIG. 3 with the camshaft phaser in a retard mode; and, FIG. 10 is a cross-sectional view taken generally along line 10-10 in FIG. 3.

FIG. 9 is a cross-sectional view taken generally along line 9-9 in FIG. 3 with camshaft phaser 104 in a retard mode. FIG. 9 shows retard locking pin assemblies 150 with retard clutch 114 in an engaged mode. Actuator 122 moves actuator rod 120 to align diameter 124B with retard locking pin assemblies 150. Retard pins 152A engage retard inner ring $\mathbf{144}_{RET}$ at gaps 144D and 144A and thus torque is transferred between camshaft 102 and retard inner ring $\mathbf{144}_{RET}$. Retard rollers $\mathbf{142}_{RET}$ ride up ramps 140A and force retard outer ring $\mathbf{140}_{RET}$ to expand radially outward and frictionally engage input component 108 radially inwardly facing surface $\mathbf{108}_{IC}$ (i.e., gap 146 does not exist), when input component 108 rotates in direction CD1 relative to camshaft 102. As such, torque is transferred between input component 108 and camshaft 102.

Figure 10:
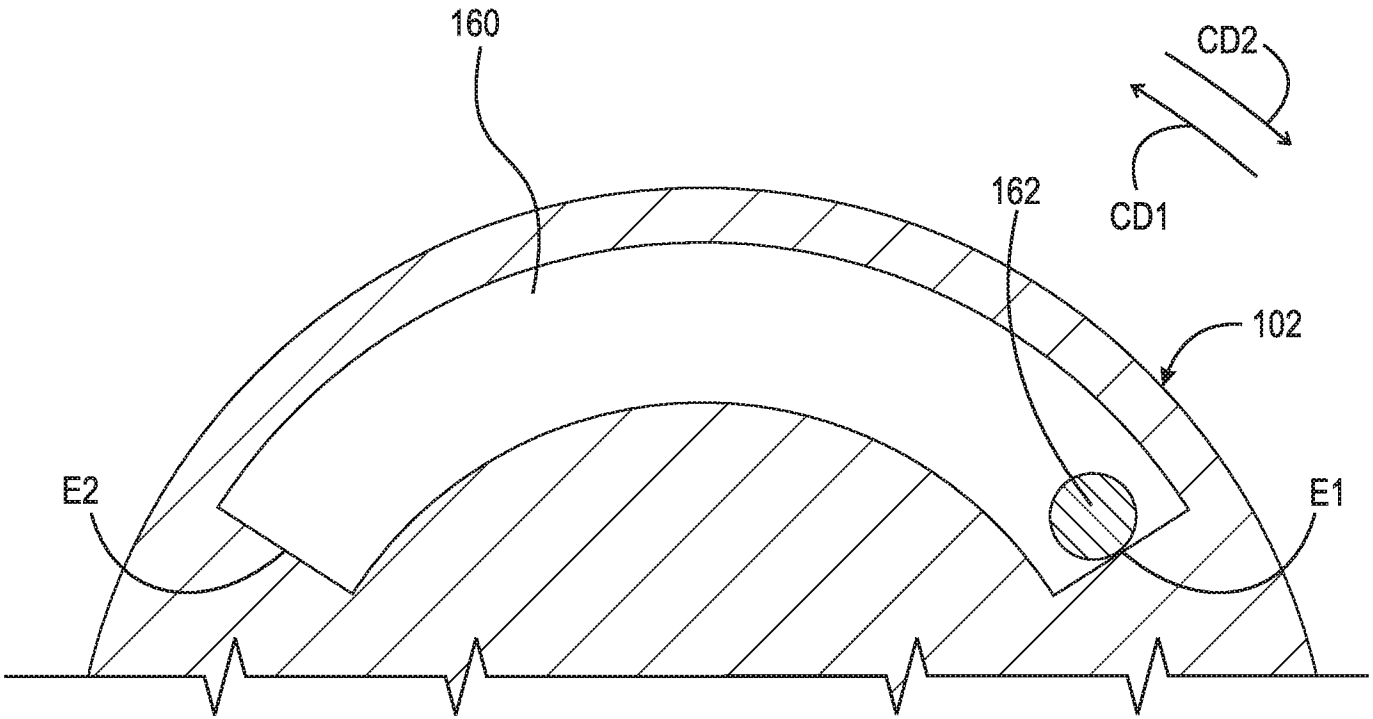

FIG. 10 is a cross-sectional view taken generally along line 10-10 in FIG. 3. In an example embodiment, camshaft 102 comprises slot 160 arranged on camshaft flange 134. Pin 162 protrudes from input component 108 and extends into slot 160, which has first end E1 and second end E2 representing fully advanced or fully retarded mode. FIG. 10 shows pin 162 abutted against first end E1, which, depending on the orientation of camshaft phaser assembly 100, results in camshaft phaser 104 being in either fully advanced or fully retarded mode. For example, if first end E1 is in fully advanced mode, then rotating camshaft phaser 104 such that pin 162 abuts against second end E2 would result in fully retarded mode. Camshaft phaser 104 can be locked in mid-lock position in which pin 162 would be located at a position between first and second ends E1 and E2. In an example embodiment, a pin can be assembled to radially protrude from camshaft 102 radially outwardly facing surface $\mathbf{102}_{OC}$ to interfere with an opposite feature protruding from input component 108 radially inwardly facing surface $\mathbf{108}_{IC}$.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Cylindrical coordinate system
11 Longitudinal axis
12 Object
13 Object
14 Object
15 Axial surface
16 Radial surface
17 Radius
18 Surface
19 Circumference
AD Axial direction
CD Circumferential direction
RD Radial direction
100 Camshaft phaser assembly
102 Camshaft
$\mathbf{102}_{OC}$ Camshaft radially outwardly facing surface
104 Camshaft phaser

106 Nut
108 Input component
108$_{IC}$ Input component radially inwardly facing surface
108A Drive sprocket
110 Thrust washer
112A Thrust bearing
112B Thrust bearing
114 Retard clutch
116 Advance clutch
120 Actuator rod
122 Actuator
124A Actuator rod diameter
124B Actuator rod diameter
124C Actuator rod diameter
126 Actuator channel
128A Retard channels
128B Advance channels
130 Bearing
132 Bias spring
134 Camshaft flange
140 Outer ring
140$_{OC}$ Outer ring radially outwardly facing surface
140$_{IC}$ Outer ring radially inwardly facing surface
140A Ramps
142 Rollers
144 Inner ring
144$_{OC}$ Inner ring radially outwardly facing surface
144$_{IC}$ Inner ring radially inwardly facing surface
144A Gap
144B Gap
144C Gap
144D Gap
144E Gap
144F Gap
146 Radial gap
150 Retard locking pin assembly
150A Retard pin
150B Retard retainer ring
150C Retard spring
152 Advance locking pin assembly
152A Advance pin
152B Advance retainer ring
152C Advance spring
160 Slot
162 Pin
E1 End one
E2 End two
AR Axis of rotation
AD1 Axial direction one
AD2 Axial direction two
CD1 Circumferential direction one
CD2 Circumferential direction two
RD1 Radial direction one
RD2 Radial direction two

What is claimed is:

1. A camshaft phaser, comprising:

an input component arranged to receive torque from an engine;

an advance inner ring;

a plurality of rollers circumferentially arranged around the advance inner ring;

an advance outer ring radially disposed between the input component and the advance inner ring; and, an actuation assembly arranged to be disposed in a channel for a camshaft, the actuation assembly comprising:

one or more advance locking pin assemblies operatively arranged in one or more advance channels; and, for an advanced mode:

an actuator rod is arranged to radially displace the one or more advance locking pin assemblies to engage the advance inner ring such that the camshaft and the advance inner ring are non-rotatably connected;

the advance inner ring is arranged to rotate, with respect to the input component, in a first circumferential direction; and, the advance outer ring is arranged to block rotation of the advance inner ring with respect to the input component, in a second circumferential direction, opposite the first circumferential direction.

2. The camshaft phaser as recited in claim 1, wherein:

the advance outer ring includes a first plurality of ramps extending radially inward along the first circumferential direction; and, for rotation of the advance inner ring, with respect to the input component, in the first circumferential direction, the first plurality of ramps and the plurality of rollers are arranged to circumferentially displace with respect to each other to displace the advance outer ring radially outward to non-rotatably connect the input component, the advance outer ring, and the advance inner ring.

3. The camshaft phaser as recited in claim 1, further comprising:

a retard inner ring; and, a retard outer ring radially disposed between the input component and the retard inner ring, wherein:

the actuation assembly includes one or more retard locking pin assemblies operatively arranged in one or more retard channels; and, for a retard mode:

the actuator rod is arranged to radially displace the one or more retard locking pin assemblies to engage the retard inner ring such that the camshaft and the retard inner ring are non-rotatably connected;

the retard inner ring is arranged to rotate, with respect to the input component, in the second circumferential direction; and, the retard outer ring is arranged to block rotation of the retard inner ring with respect to the input component, in the first circumferential direction.

4. The camshaft phaser as recited in claim 3, wherein:

the retard outer ring includes a second plurality of ramps extending radially inward along the second circumferential direction; and, for rotation of the retard inner ring, with respect to the input component, in the second circumferential direction, the second plurality of ramps and the plurality of rollers are arranged to circumferentially displace with respect to each other to displace the retard outer ring radially outward and non-rotatably connect the input component, the retard outer ring, and the retard inner ring.

5. The camshaft phaser as recited in claim 4, wherein:

for the advance mode, the retard inner ring is rotatable with respect to the one or more retard locking pin assemblies and the camshaft, or the input component; and, for the retard mode, the advance inner ring is rotatable with respect to the one or more advance locking pin assemblies and the camshaft, or the input component.

6. The camshaft phaser as recited in claim 3, wherein:
the actuator rod includes:
a first and second portion having first and second outer radii, respectively; and,
a third portion having a third outer radius greater than the first and second radii;
for the advance mode, the actuator rod is displaceable so that the second and third portions directly engage the one or more retard and the one or more advance locking pin assemblies, respectively; and,
for the retard mode, the actuator rod is displaceable so that the first and third portions directly engage the one or more advance and the one or more retard locking pin assemblies, respectively.

7. The camshaft phaser as recited in claim 6, wherein for a drive mode:
the actuator rod is displaceable so that the third portion directly engages the one or more advance and the one or more retard locking pin assemblies;
the one or more advance and the one or more retard locking pin assemblies engage the advance and retard inner rings, respectively, such that the advance and retard inner rings are non-rotatably connected with the camshaft; and,
the advance and retard inner rings each transmit torque from the input component to the camshaft.

8. The camshaft phaser as recited in claim 7, wherein:
the input component is arranged to rotate in the first circumferential direction;
the camshaft is arranged to rotate with respect to the input component in the first and second circumferential directions during alternating first and second time periods, respectively; and,
for the drive mode:
during the first time period, the retard inner ring is arranged to transmit torque from the input component to the camshaft; and,
during the second time period, the advance inner ring is arranged to transmit torque from the input component to the camshaft.

9. The camshaft phaser as recited in claim 3, wherein the camshaft phaser includes:
a first resilient element, for the retard mode, arranged to displace the one or more advance locking pin assemblies radially inward to disengage from the advance inner ring; and,
a second resilient element, for the advance mode, arranged to displace the one or more retard locking pin assemblies radially inward to disengage from the retard inner ring.

10. The camshaft phaser as recited in claim 9, further comprising:
a bias spring operatively arranged in the camshaft channel to move the actuator rod to a failsafe or neutral position for engine shutdown or in case of an actuator failure.

11. The camshaft phaser as recited in claim 10, wherein:
the one or more retard locking pin assemblies engage the retard inner ring through a plurality of gaps radially located on the retard inner ring; and,
the one or more advance locking pin assemblies engage the advance inner ring through a plurality of gaps radially located on the advance inner ring.

12. The camshaft phaser as recited in claim 11, further comprising a pin protruding from the camshaft and extending into a channel in the input component, wherein the input component channel includes:
a first end interfering with the pin designating a fully retarded mode; and,
a second end interfering with the pin designating a fully advanced mode.

13. The camshaft phaser as recited in claim 11, further comprising one or more protrusions on the camshaft and one or more projections on the input component, wherein:
interference of the one or more protrusions with the one or more projections designates at least one of a fully retarded mode or a fully advanced mode.

14. A camshaft assembly, comprising:
a camshaft including one or more advance channels and one or more retard channels; and,
a camshaft phaser including:
an advance inner ring;
a retard inner ring; and
an actuation assembly including:
one or more advance locking pin assemblies disposed in the one or more advance channels; and,
one or more retard locking pin assemblies disposed in the one or more retard channels; and,
an actuator rod, wherein:
for an advance mode:
the actuator rod is arranged to radially displace the one or more advance locking pin assemblies into non-rotatable contact with the advance inner ring;
the camshaft is arranged to rotate, with respect to an input component, in a first circumferential direction; and,
the advance inner ring is arranged to block rotation of the camshaft, with respect to the input component, in a second circumferential direction, opposite the first circumferential direction; and,
for a retard mode:
the actuator rod is arranged to radially displace the one or more retard locking pin assemblies into non-rotatable contact with the retard inner ring;
the camshaft is arranged to rotate, with respect to the input component, in the second circumferential direction; and,
the retard inner ring is arranged to block rotation of the camshaft, with respect to the input component in the first circumferential direction.

15. The camshaft assembly as recited in claim 14, wherein:
the camshaft phaser includes an advance outer ring radially disposed between the input component and the advance inner ring, and a plurality of rollers radially disposed between the advance outer ring and the advance inner ring;
the advance outer ring includes a first plurality of ramps extending radially inward along the first circumferential direction and engaged with the plurality of rollers; and,
for rotation of the advance inner ring, with respect to the input component, in the first circumferential direction, the first plurality of ramps and the plurality of rollers are arranged to circumferentially displace with respect to each other to displace the advance outer ring radially outward to non-rotatably connect the input component, the advance outer ring, and the advance inner ring.

16. The camshaft assembly as recited in claim 14, wherein:
the camshaft phaser includes a retard outer ring radially disposed between the input component and the retard inner ring, and a plurality of rollers radially disposed between the retard outer ring and the retard inner ring;

the retard outer ring includes a second plurality of ramps extending radially inward along the second circumferential direction and engaged with the plurality of rollers; and, for rotation of the retard inner ring, with respect to the input component, in the second circumferential direction, the second plurality of ramps and the plurality of rollers are arranged to circumferentially displace with respect to each other to displace the retard outer ring radially outward and non-rotatably connect the input component, the retard outer ring, and the retard inner ring.

17. The camshaft assembly as recited in claim 14, wherein:

for the advance mode, the retard inner ring is rotatable with respect to the one or more retard locking pin assemblies and the camshaft, or the input component; and, for the retard mode, the advance inner ring is rotatable with respect to the one or more advance locking pin assemblies and the camshaft, or the input component.

18. The camshaft assembly as recited in claim 14, wherein:

the actuator rod includes:

a first and second portion having first and second outer radii, respectively; and, a third portion having a third outer radius greater than the first and second radii;

for the advance mode, the actuator rod is displaceable so that the second and third portions directly engage the one or more retard and the one or more advance locking pin assemblies, respectively; and, for the retard mode, the actuator rod is displaceable so that the first and third portions directly engage the one or more advance and the one or more retard locking pin assemblies, respectively.

19. The camshaft phaser as recited in claim 18, wherein for a drive mode:

the actuator rod is displaceable so that the third portion directly engages the one or more advance and the one or more retard locking pin assemblies;

the one or more advance and the one or more retard locking pin assemblies engage the advance and retard inner rings, respectively, such that the advance and retard inner rings are non-rotatably connected with the camshaft; and, the advance and retard inner rings each transmit torque from the input component to the camshaft.

20. The camshaft phaser as recited in claim 19, wherein:

the input component is arranged to rotate in the first circumferential direction;

the camshaft is arranged to rotate with respect to the input component in the first and second circumferential directions during alternating first and second alternating time periods, respectively; and, for the drive mode:

during the first time period, the retard inner ring is arranged to transmit torque from the input component to the camshaft; and, during the second time period, the advance inner ring is arranged to transmit torque from the input component to the camshaft.

* * * * *